United States Patent [19]

Brooks et al.

[11] Patent Number: 4,755,284

[45] Date of Patent: Jul. 5, 1988

[54] ELUTRIATOR

[75] Inventors: Derrick W. Brooks, Radcliffe-on-Trent; Christopher P. Morris, Carlton, both of United Kingdom

[73] Assignee: Hambra Machinery Limited, United Kingdom

[21] Appl. No.: 73,398

[22] Filed: Jul. 10, 1987

Related U.S. Application Data

[63] Continuation of Ser. No. 722,352, Apr. 12, 1985, abandoned.

[30] Foreign Application Priority Data

Apr. 14, 1984 [GB] United Kingdom ..... 8409766

[51] Int. Cl.[4] ..... B07B 4/08; B07B 9/02; A24B 3/16

[52] U.S. Cl. ..... 209/20; 131/110; 209/139.1; 209/154; 209/466; 209/474; 209/502

[58] Field of Search ..... 209/20, 44.2, 132, 133, 209/136, 137, 138, 139.1, 142, 146, 147, 149, 151, 154, 422, 466, 474, 486, 502; 131/108, 109.2, 110, 300, 301, 312, 318

[56] References Cited

U.S. PATENT DOCUMENTS

| | | | |
|---|---|---|---|
| 1,720,861 | 7/1929 | Stebbins | 209/20 |
| 2,141,451 | 12/1938 | Ridley | 209/466 X |
| 2,586,223 | 2/1952 | Harmon | 209/151 X |
| 2,815,860 | 12/1957 | Krantz et al. | 209/20 |
| 3,437,202 | 4/1969 | Kaiser | 209/149 X |
| 3,446,355 | 5/1969 | Boucraut et al. | 209/502 X |
| 4,646,579 | 3/1987 | Thatcher et al. | 131/110 |

FOREIGN PATENT DOCUMENTS

| | | | |
|---|---|---|---|
| 0624488 | 7/1961 | Canada | 209/474 |
| 2314754 | 6/1975 | France | 209/474 |
| 0052669 | 5/1942 | Netherlands | 209/20 |
| 2026668 | 2/1980 | United Kingdom . | |
| 2119495 | 11/1983 | United Kingdom . | |

*Primary Examiner*—Robert B. Reeves
*Assistant Examiner*—Edward M. Wacyra

[57] ABSTRACT

An elutriator (1) for separating different grades of leaf vegetable material comprises an elutriation zone (17) disposed above a flow distributor, and gaseous supply means (13) for supplying a gaseous medium to the elutriation zone (17) through the flow distributor. The flow distributor is adapted to provide a substantially uniform flow of gaseous medium to the elutriation zone (17), and the velocity of air delivered to the zone is greater than the terminal velocity of at least one grade of the material to be separated.

20 Claims, 3 Drawing Sheets

ELUTRIATOR

This application is a continuation of application Ser. No. 722,352 filed Apr. 12, 1985 and now abandoned.

BACKGROUND OF THE INVENTION

This invention relates to an alutriator, and more particularly relates to an elutriator for separating different grades of leaf or fibrous vegetable material.

Known apparatus for the separation of different grades of leaf vegetable material generally includes a rapidly flowing upward air stream into which the material is fed.

The principle involved in such apparatus is that different grades of leaf vegetable material have different terminal velocities. Consequently those grades with lower terminal velocities should rise in the upward air stream to the top of the apparatus from where they can be removed; those grades with higher terminal velocities should fall to, or remain at the bottom of the apparatus.

In practice it is difficult to achieve an efficient separation, and it is often necessary to recycle part of the separated material several times, or to pass it through additional separating apparatus.

In prior devices the upward air flow rate has been much higher than the lowest terminal velocity of the grades of leaf material in order to separate acceptable amounts of low terminal velocity material.

However, the provision of such high air velocities causes turbulence which can disadvantageously affect the efficiency of the separation.

One way in which this problem has been partially overcome is by winnowing (i.e. throwing) the leaf vegetable material upwardly into the apparatus at high velocity. This improves the efficiency of the separation, but leads to degradation by breakage and bruising and increased running costs; it is also necessary to use air locks in the apparatus, and these increase the possibility of blockages and build-ups in the material flow.

SUMMARY OF THE INVENTION

It is an object of the present invention to overcome the aforementioned disadvantages.

According to one aspect of the present invention there is provided an elutriator for separating different grades of leaf vegetable material, comprising an elutriation zone disposed above distribution means, and gaseous supply means for supplying a gaseous medium to said zone through the distribution means, said distribution means being adapted to provide a substantially uniform flow of gaseous medium to the zone, wherein, in use the velocity of air delivered to the zone is greater than the terminal velocity of at least one grade of the material to be separated.

We have found that the provision of a uniform air flow above the distribution means results in a considerably more efficient separation at much lower air flow rates. Advantageously the direction of the air flow is upwards and substantially vertical so that it is in a direction opposite to the downward weight of the tobacco material.

To provide the uniform air flow the distribution means advantageously comprises at least one perforated plate in which each aperture of the plate is dimensioned so that it has a cross-sectional area in the range of $20\times10^{-6}$ sq. inches (approximately $130\times10^{-6}$ cm$^2$) to $1000\times10^{-6}$ sq. inches (approximately $6450\times10^{-6}$ cm$^2$).

Preferably the apertures each have a cross-sectional area in the range $80\times10^{-6}$ sq. inches (approximately $520\times10^{-6}$cm$^2$) to $700\times10^{-6}$ sq. inches (approximately $4520\times10^{-6}$cm$^2$), more preferably $170\times10^{-6}$ sq. inches (approximately $1100\times10^{-6}$cm$^2$) to $500\times10^{-6}$ sq. inches (approximately $3220\times10^{-6}$cm$^2$), and most preferably $300\times10^{-6}$ sq. inches (approximately $1940\times10^{-6}$ cm$^2$).

Preferably the total area of the apertures is in the range 4% to 12%, more preferably 8% to 9%, and most preferably 8.6%, of the total area of the or each plate.

The distribution means is preferably such as to provide a pressure drop across the bed of 0.5 inches to 12 inches (1.25 cm to 30 cm), more preferably 1 inch to 12 inches (approximately 2.5 cm to 30 cm) water gauge, more preferably 1 inch to 8 inches (approximately 2.5 cm to 20 cm) water gauge, and most preferably 2 inches to 4 inches (approximately 5 cm to 10 cm) water gauge.

Desirably, gaseous withdrawal means is provided for withdrawing the gaseous medium from the elutriation zone, and the rate of flow of gaseous medium supplied by the gaseous supply means is substantially equal to the rate of flow of gaseous medium withdrawn by the gaseous withdrawal means.

Conveniently means can be provided to vibrate the elutriator; this may comprise one or more agitation motors. In addition, means may be provided to facilitate adjustment of the orientation of the bed. These features are described in more detail in our copending U.K. Patent Application No. 83113368, published under the number GB No. 2,119,495A.

The gaseous supply means and the gaseous withdrawal means may comprise a single fan. However, it is preferred that a separate fan is provided for the gaseous supply means and for the gaseous withdrawal means.

It is preferred that the gas flow velocity in the elutriation zone immediately above the distribution means is in the range 150 to 800 ft/minute (approx. 49 m/minute to 244 m/minute), more preferably 350 to 550 ft/minute (approx. 115 m/minute to 180 m/minute) and most preferably about 450 minute (approx. 148 m/minute). The precise value of the velocity depending upon the material being separated.

The apertures may have a circular cross-section, in which case the diameter of each aperture is preferably in the range 5 thou ($12.7\times10^{-3}$ cm) to 35 thou ($89\times10^{-3}$ cm), more preferably 10 thou ($15.4\times10^{-3}$ cm) to 30 thou ($77\times10^{-3}$ cm), more preferably 15 thou ($38\times10^{3}$ cm) to 25 thou ($62.5\times10^{-3}$ cm), and most preferably 20 thou ($51\times10^{-3}$ cm).

The thickness of the distribution plate may be in the range 5 thou to 30 thou ($12.7\times10^{-3}$ cm to $77\times10^{-3}$ cm), preferably 10 thou to 20 thou ($25.4\times10^{-3}$ cm to $51\times10^{-3}$ cm).

In a preferred construction, the elutriator is provided with a pretreatment zone adjacent the elutriation zone, the pretreatment zone also being disposed above the distribution means, wherein, in use, the velocity of air delivered to the pretreatment zone is lower than the lowest terminal velocity of substantially all grades of the leaf vegetable material.

In this construction the distribution means may be provided with at least one additional perforated plate which is disposed beneath the pretreatment zone. The cross-sectional area of the apertures of the or each additional plate may be the same as those described above in respect of the or each plate under the elutriation zone.

The total area of the apertures of the or each additional plate may be in the range of one and one half percent to two and three quarters percent of the total area of the or each additional plate.

In one embodiment the total area of the apertures of the or each additional plate may be in the range of one and one half percent to two percent of the total area of the or each additional plate.

In another embodiment the total area of the apertures of the or each additional plate is in the range of two percent to two and three quarters percent, more preferably two and one quarter percent to two and three quarters percent of the total area of the or each additional plate. In this embodiment, the most preferable range of the total area of the apertures is between two and one fourth percent and 2.6% of the total area of the or each additional plate. The or each additional plate may advantageously be provided with a total area of apertures which is substantially two and one half percent of the total area of the or each additional plate.

The difference between the total area of the apertures of the or each plate and the total area of the apertures of the or each additional plate causes the gas flow rate in the elutriation zone to be correspondly higher than in the pretreatment zone, so that it is not necessary to provide separate gaseous supply means for the pretreatment zone and the elutriation zone.

The gas flow velocity in the pretreatment zone is preferably in the range 50 to 200 ft/minutes (approximately 16 m/minute to 64 m/minute), more preferably 75 and 150 ft/minute (approximately 24 m/minute to 48 m/minute) and most preferably 120 to 130 ft/minute (approximately 38 m/minute to 41 m/minute).

The thickness of the or each perforated plate and the or each additional plate may be in the range 5 thou to 30 thou ($12.7\times10^{-3}$ cm to $77\times10^{-3}$ cm), preferably 10 thou to 20 thou ($25.4\times10^{-3}$ cm to $51\times10^{-3}$ cm).

The or each plate and the or each additional plate may be, for example, a metallic or plastics material; preferably they are stainless steel.

The apertures in the plates may be produced by any convenient method, for example, by punching, by laser beam drilling or by chemical milling such as photoetching.

The elutriator of the present invention has many advantages over prior classification devices, and is particularly useful when the leaf vegetable material is a tabacco material.

The tobacco material may be threshed leaf tobacco which comprises a mixture of stem, lamina, and stem with lamina attached; the lamina is the leaf part of the tobacco. The lamina may be removed from the elutriator as top product, and the stem, and stem with attached lamina, can be recovered as bottom product.

The recovered lamina may be subjected to treatment in a further elutriator in order to separate different grades of the lamina.

Furthermore, the recovered stem can also be subjected to treatment in a further elutriator in order to separate different grates of the stem.

The elutriator according to the invention can be used with existing tobacco conditioning apparatus, without the need to modify the conditioning apparatus. Examples of such conditioning apparatus are described in our U.K. Application No. 8313368 and our U.K. Pat. No. 2026668.

The elutriator according to the invention achieves better separation at lower gas flow velocities than has previously been feasible. This results in decreased running costs.

In addition, there is no need for air locks in the apparatus, and this reduces the possibility of the blockages and build up in the material flow.

BRIEF DESCRIPTION OF THE DRAWINGS

Reference is now made to the accompanying drawings in which.

DESCRIPTION OF THE PREFERRED EMBODIMENTS

Figure 1:
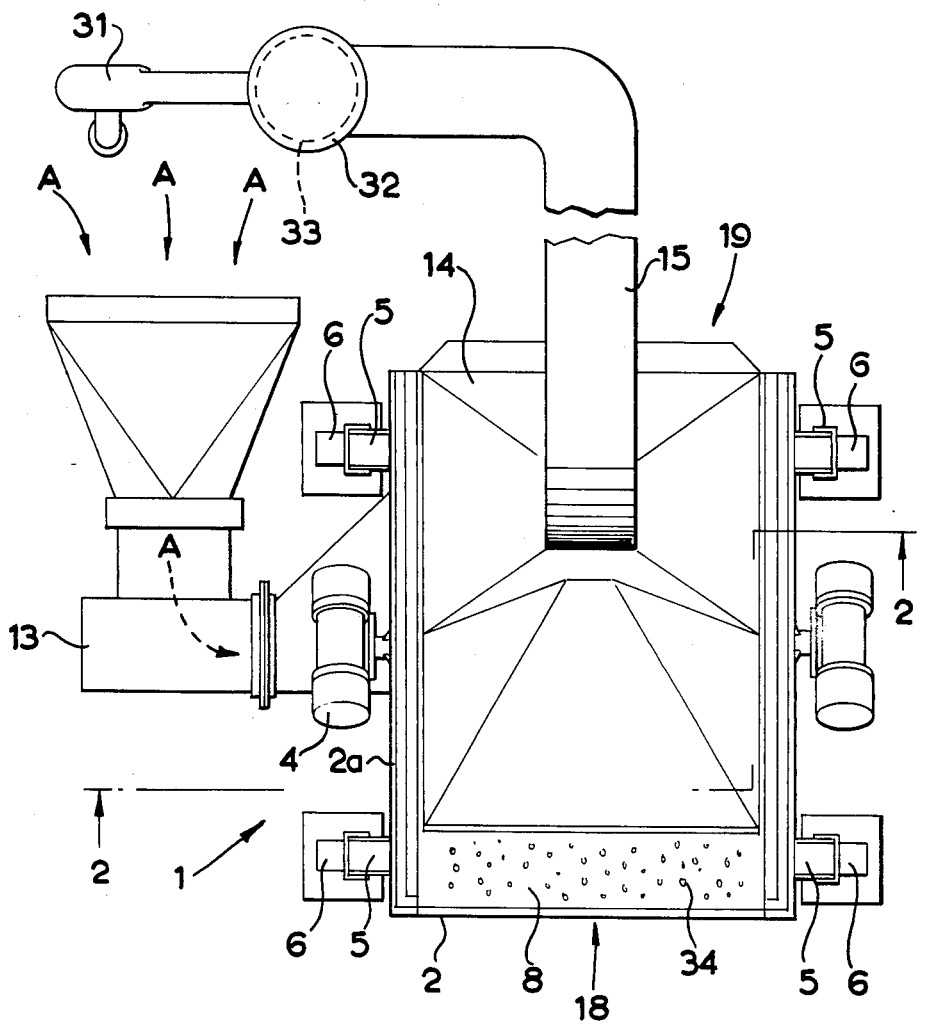
FIG. 1 is a plan view of an elutriator according to the invention.

In the drawings an elutriator generally designated 1 includes a housing 2 which has an upper part 2*a* and a lower part 2*b*. The upper part 2*a* is connected to the lower part 2*b* by means of a flexible seal 3. The provision of the flexible seal 3 permits the upper part 2*a* to be vibrated relative to the lower part 2*b* by means of agitators 4.

Spring suspension units 5 are provided on mountings 6 which rest on a floor 30, and the suspension units are attached to the upper part 2*a* of the housing 2. The construction of the suspension unit 5 is the same as that described in our earlier United Kingdom Patent Application No. 8313368.

The housing 2 defines a plenum chamber 7, which plenum chamber underlies distribution means. The distribution means comprises two perforated plates 10 and 11, and an additional perforated plate 9. A non-perforated feed plate 8 is provided adjacent the plate 9.

Within the plenum chamber 7 a plurality of air diverting plates 12 are arranged so that air can flow between adjacent plates 12. The plates 12 are bolted to the housing 2. The orientation of the plates 12 is adjustable.

An air supply fan 13 is provided to supply air to the plenum chamber 7.

Figure 2:
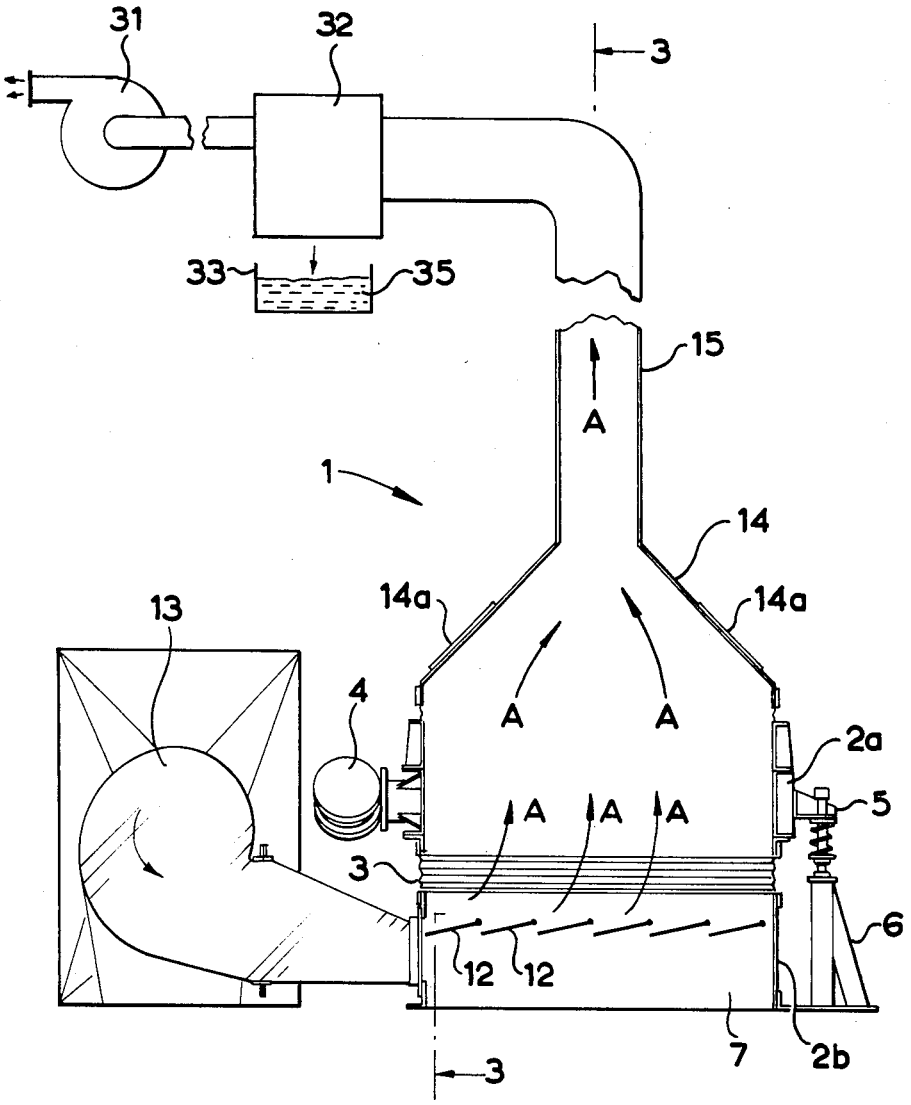
FIG. 2 is a view on lines 2—2 of FIG. 1.
Figure 3:
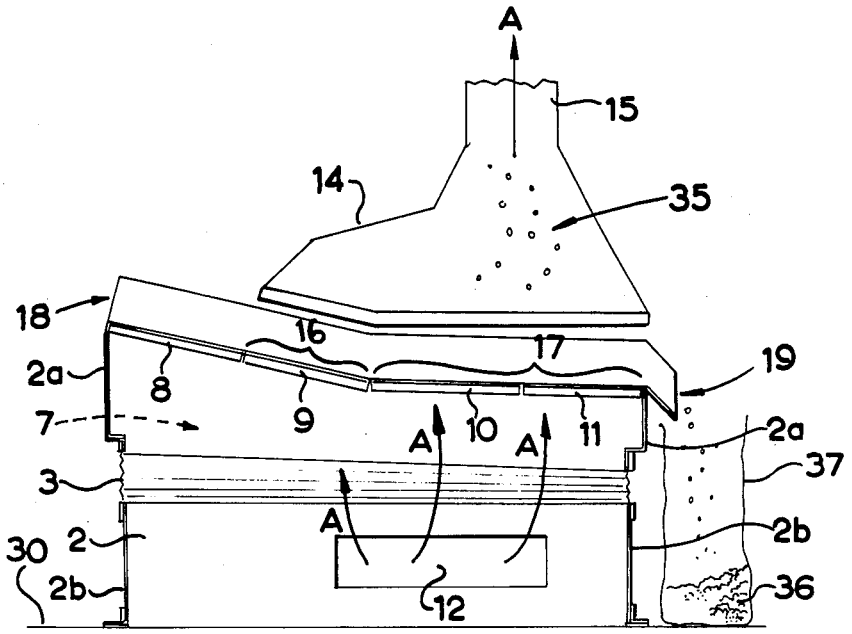
FIG. 3 is a view on lines 3—3 of FIG. 2.

A hood 14 is arranged above the perforated plates 10 and 11, and the additional perforated plate 9, and has an exhaust duct 15 which is connected to a suction fan 31. A separator 32 which is shown diagrammatically, is provided between the exhaust duct 15 and the suction fan 31 in order to remove the top product from the air flow. The separator 32 may comprise separation apparatus as described in our U.K. Pat. No. 1,575,175. The top product is collected in a collector 33. Inspection windows 14*a* are provided in the hood 14 (not shown in FIGS. 1 and 2).

The fans 13 and 31 may be, for example, high efficiency centrifugal fans, or high pressure axial fans.

The plates 10 and 11 are disposed below an elutriation zone 17, and the additional plate 9 is disposed below a pretreatment zone 16. An inlet 18 for material 34 to be separated is provided adjacent the feed plate 8, and an outlet 19 is provided adjacent the elutriation zone 17. The feed plate 8 is disposed adjacent the pretreatment zone 16.

Figure 4:
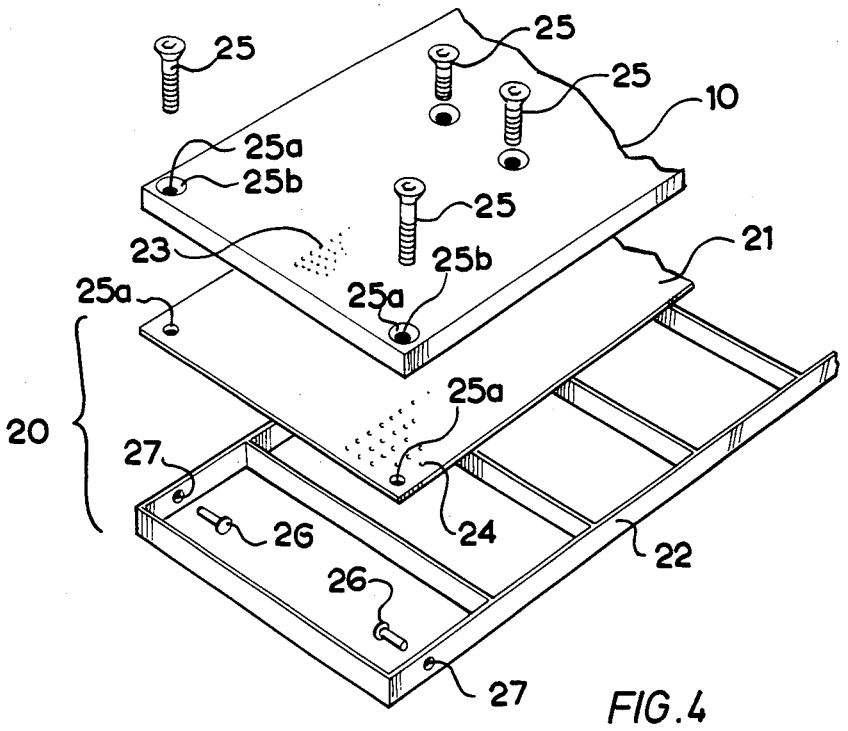
FIG. 4 is an exploded perspective view of a distribution means for the elutriator according to the invention and support means therefor.

The way in which the plate 10 is arranged above the plenum chamber 7 is shown in FIG. 4. It will be appreciated that the plate 11 and the additional plates 8 and 9 are arranged in a similar manner.

The plate 10 is supported by support means 20 comprising a support plate 21 which is supported by a support tray 22. The plate 10 is provided with apertures 24. The apertures 23 and 24 are of substantially circular cross-section, and the apertures 24 are larger than the apertures 23. For example, the diameter of the apertures 23 is preferably about 20 thou ($51\times10^{-3}$ cm). The diameter of apertures 24 is preferably about 3/16 inches (approximately 0.47 cm). The distance between the centres of the apertures 24 may be about 5/16 inches (0.8 cm). This gives a total aperture area of 33% of the total area of the plate 21. The thickness of the support plate 21 may be about 18 swg ($1.2\times10^{-3}$cm).

Screws 25 are employed to hold the plate 10, the support plate 21, and the support tray 22 together. The screws 25 pass through apertures **25*a* in the plates 10 and 21. The apertures 25*a* in the plate 10 are provided with countersunk portions 25*b* Iso that the heads of the screws 25 lie flush with the plate 10. Screws 26 are provided to secure the support tray 22 to the upper part 2*a* of the housing 2, and are arranged to extend through apertures 22** of the support tray.

The arrangement of the support plate 21 underneath the distribution plate 10 assists in preventing particles of material to be separated from being caught between the plates 10 and 21; this is because the material is less likely to be able to pass through the smaller apertures of the plate 10.

The percentage of the total plate area occupied by the apertures in the additional plate 9 is much less than the percentage of the total plate area occupied by the apertures in the plates 10 and 11. This causes the air flow velocity through the plates 10 and 11 to be much greater than that through the additional plate 9. The air flow supplied by the fan 13 is calibrated so that the air velocity through the additional plate 9 is less than the lowest terminal velocity of substantially all of the material to be separated, while the air velocity through the plates 10 and 11 is greater than the terminal velocity of at least part of the material. It is preferred that the cross sectional area of each of the plates 9, 10 and 11 is substantially the same, and that the number of apertures per square metre in the additional plate 9 is less than in the plates 10 and 11. For example, the plates 10 and 11 can be provided with 300 apertures per square metre, and the plate 9 can be provided with 81 apertures per square metre.

The operation of the elutriator 1 for the application of separating different grades of tobacco material will now be described.

Air is supplied to the plenum chamber 7 by the air supply fan 13 and flows upwardly therethrough. The air is directed upwardly to the perforated plates 10 and 11, and to the additional perforated plate 9, by the air diverting plates 12. The suction fan 31 draws air from the hood 14, and the rate of air extracted by the suction fan is adjusted so that it is equal to the rate of air supplied from the air supply fan 13. In this way air flows through the plates 10 and 11 and the additional plate 9, through the pretreatment and elutriation zones 16 and 17, into the hood 14 and up into the exhaust 15. The provision of an air extraction rate substantially equal to the air supply rate helps to prevent air flowing in or out through the gap between the housing 2 and the hood 14. The direction of air flow is indicated by arrows A in the drawings.

Tobacco 34 is fed into the inlet 18 onto the feed plate 8 from where it flows to the additional perforated plate 9 in the pretreatment zone 16. In the pretreatment zone 16 the tobacco 34 is immediately partially fluidised by the air flowing through the additional plate 9, and by the vibration supplied by the agitators 4. In this way a partially fluidised bed is formed in the pretreatment zone 16 in which the tobacco 34 is evenly distributed, and is levelled to a constant depth. It is also stratified because lighter particles migrate towards the top of the bed while heavier particles migrate towards the bottom of the bed. Apart from dust particles, substantially none of the tobacco 34 is drawn off into the hood 14 from the pretreatment zone 16.

The tobacco 34 flows from the pretreatment zone 16 to the elutriation zone 17. In the elutriation zone 17, the high air velocity causes lighter grades 35 of tobacco 34 to be drawn up through the hood 14 and into the exhaust duct 15. Due to the decrease in cross-sectional area at the exhaust duct 15 the velocity of air increases, thus accelerating the separated tobacco through the exhaust duct. The lighter grades 35 are passed through the separator 32 and are collected in the collector 33.

The heavier grades 36 of tobacco remain adjacent the plates 10 and 11 in a substantially fluidised state until they pass through the outlet 19, and are collected in collector 37.

It will be appreciated that the operation of the elutriator would be similar for other leaf or fibrous vegetable materials such as tea.

The elutriator 1 may be modified, for example, by the provision of two separate hoods each having separate exhaust ducts. One of the hoods can be disposed over the pretreatment zone 16, and the other can be disposed over the elutriation zone 17. In this way, the dust particles drawn off in the pretreatment zone 16 are separated from the lighter grades drawn off in the elutriation zone 17.

Furthermore, it is not necessary that all the distribution plates in the elutriation zone have the same cross sectional area for air flow. For example it is possible to provide a series of distribution plates with increasing cross sectional areas for air flow so that the velocity of air through successive plates increases. A separate hood can be provided above each plate so that a different grade of material can be drawn off through each hood.

We claim:

1. An elutriator for separating different grades of leaf vegetable material, comprising:

means defining an elutriation zone of predetermined area for receiving the material;

fluid distribution means disposed below said elutriation zone for providing a flow of gaseous medium upwardly into said zone;

gaseous supply means operative to supply a gaseous medium to said fluid distribution means; and said fluid distribution means providing a flow of gaseous medium to said zone at a velocity greater than the terminal velocity of at least one grade of the material to be separated, and substantially uniform throughout the area of said zone, so that the average velocity throughout said zone is substantially the same as the minimum and maximum velocities, permitting elutriation at relatively reduced velocities and thereby improving the efficiency of the separation.

2. An elutriator according to claim 1 in which the distribution means comprises at least one perforated plate having a plurality of apertures.

3. An elutriator according to claim 2 in which the cross-sectional area of each aperture of said at least one perforated plate is in the range of $20\times10^{-6}$ sq. inches (approximately $130\times10^{-6}$ $cm^2$) to $1000\times10^{-6}$ sq. inches (approximately $6450\times10^{-6}$ $cm^2$).

4. An elutriator according to claim 2 in which the cross-sectional area of each aperture of said at least one perforated plate is in the range $80\times10^{-6}$ sq. inches (approximately $520\times10^{-6}$ $cm^2$) to $700\times10^{-6}$ sq. inches (approximately $4520\times10^{-6}$ $cm^2$).

5. An elutriator according to claim 2 in which the cross-sectional area of each aperture of said at least one perforated plate is in the range $170\times10^{-6}$ sq. inches (approximately $1100\times10^{-6}$ $cm^2$) to $500\times10^{-6}$ sq. inches (approximately $3220\times10^{-6}$ $cm^2$).

6. An elutriator according to claim 2 in which the cross-sectional area of each aperture of said at least one perforated plate is substantially $300\times10^{-6}$ sq. inches (approximately $1940\times10^{-6}$ $cm^2$).

7. An elutriator according to claim 2 in which the total area of the apertures of said at least one perforated plate is in the range 4 percent to 12 percent of the total area of said at least one perforated plate.

8. An elutriator according to claim 2 in which the total area of the apertures of said at least one perforated plate is in the range 8 percent to 9 percent of the total area of said at least one perforated plate.

9. An elutriator according to claim 2 in which the total area of the apertures of said at least one perforated plate is susbtantially 8.6 percent of the total area of said at least one perforated plate.

10. An elutriator according to claim 1 in which the distribution means is such as to provide a pressure drop across the zone of 0.5 inch to 12 inches water gauge.

11. An elutriator according to claim 1 in which the distribution means is such as to provide a pressure drop across the zone of 1 inch to 8 inches water gauge.

12. An elutriator according to claim 1 in which gaseous withdrawal means is provided for withdrawing the gaseous medium from the elutriation zone, and the rate of flow of gaseous medium supplied by said gaseous supply means is substantially equal to the rate of flow of gaseous medium withdrawn by the gaseous withdrawal means.

13. An elutriator according to claim 12 in which the gaseous withdrawal means and the gaseous means each comprise a fan, and a separate fan is provided for the gaseous supply means and for the gaseous withdrawal means.

14. An elutriator according to claim 1 in which a pretreatment zone is provided adjacent the elutriation zone for receiving the material before the material moves to the elutriation zone, the pretreatment zone also being disposed above the distribution means, and the distribution means delivers air to the pretreatment zone at a velocity lower than the lowest terminal velocity of substantially all the grades of the leaf vegetable material so that the material is at least partially fluidized in the pretreatment zone, allowing separation to begin as soon as the material enter the elutriation zone.

15. Abn elutriator according to claim 14 in which the distribution means is provided with at least one additional perforated plate which is disposed beneath the pretreatment zone.

16. An elutriator according to claim 15 in which the total area of the apertures of said at least one additional plate is in the range of one and one half percent to two and three quarters percent of the total area of said at least one additional plate.

17. An elutriator according to claim 15 in which the total area of the apertures of said at least one additional plate is in the range of one and one half percent to two percent of the total area of said at least one additional plate.

18. An elutriator according to claim 15 in which the total area of the apertures of said at least one additional plate is in the range of two percent to two and three quarters percent of the total area of said at least one additional plate.

19. An elutriator according to claim 15 in which the total area of the apertures of said at least one additional plate is in the range of two and one fourth percent to two and three quarters percent of the total area of said at least one additional plate.

20. An elutriator according to claim 15 in which the total area of the apertures of said at least one additional plate is in the range of two and one fourth percent to 2.6 percent of the total area of said at least one additional plate.

* * * * *